US011727831B2

(12) United States Patent
Armata

(10) Patent No.: US 11,727,831 B2
(45) Date of Patent: Aug. 15, 2023

(54) ADVERTISING SIGN

(71) Applicant: BD Patent Holdings, Inc., Barrie (CA)

(72) Inventor: Mitchell Armata, Barrie (CA)

(73) Assignee: BD Patent Holdings, Inc., Barrie (CA)

( * ) Notice: Subject to any disclaimer, the term of this patent is extended or adjusted under 35 U.S.C. 154(b) by 0 days.

(21) Appl. No.: 17/242,993

(22) Filed: Apr. 28, 2021

(65) Prior Publication Data

US 2022/0351648 A1 Nov. 3, 2022

(51) Int. Cl.
*G09F 7/18* (2006.01)

(52) U.S. Cl.
CPC ..... *G09F 7/18* (2013.01); *G09F 2007/1843* (2013.01)

(58) Field of Classification Search
CPC ..... G09F 2007/1843; G09F 7/18
See application file for complete search history.

(56) References Cited

U.S. PATENT DOCUMENTS 1,822,492 A * 9/1931 Lamb ..... G09F 1/14 40/606.19
1,822,493 A * 9/1931 Lamb ..... G09F 1/14 40/606.19
2,272,322 A * 2/1942 Kiecker ..... E01F 9/00 40/606.19
3,882,618 A * 5/1975 Hart ..... G09F 7/00 40/609
4,592,530 A * 6/1986 Seely ..... G09F 7/20 40/609
7,797,869 B2 * 9/2010 Tollis ..... G09F 15/0037 40/607.04
2005/0066560 A1 * 3/2005 Ternovits ..... G09F 15/0012 40/606.19
2008/0028653 A1 * 2/2008 Dombrowski ..... G09F 17/00 40/611.01
2008/0178504 A1 * 7/2008 Popowich ..... G09F 15/00 40/604

* cited by examiner

*Primary Examiner* — David R Dunn
*Assistant Examiner* — Christopher E Veraa
(74) *Attorney, Agent, or Firm* — Honigman LLP; Eric J. Sosenko; Jonathan P. O'Brien

(57) ABSTRACT

An advertising sign comprises a main housing to accommodate an upright passing therethrough and configured to affix to the upright at a desired height. The main housing presents forward and rearward facing, generally planar, primary advertising surfaces. Retaining assemblies extend along opposite sides of the main housing. Each retaining assembly is configured to releasably retain a secondary advertising insert that presents forward and rearward facing advertising surfaces. Forward and rearward facing upper support panels extend upwardly from the main housing and are configured to support forward and rearward facing advertising onserts thereon. Forward and rearward facing lower support panels extend downwardly from the main housing and are configured to support forward and rearward facing advertising onserts thereon.

14 Claims, 6 Drawing Sheets

ADVERTISING SIGN

BACKGROUND

1. Field of the Invention

The subject disclosure relates to an advertising sign.

2. Description of Related Technology

Advertising signs and banners are well known in the art. Such signs are particularly prevalent at entrances to businesses and in the case of restaurants and food outlets, entrances to drive throughs. In many instances, advertising signs of this nature are mounted on uprights such as poles and pylons at heights sufficient for the advertising on the signs to be readily and prominently displayed.

These advertising signs typically display static advertising that rarely, if ever, changes such as company names, brands, and/or logos. Notwithstanding, in many instances, it is desired to supplement the static advertising with additional advertising relating to sales, promotions and/or other events. As this additional advertising is often time sensitive, being able to quickly and easily supplement advertising signs with additional advertising, and then remove the additional advertising at appropriate times, is desired. To-date, conventional advertising signs have been found wanting in this respect. As will be appreciated, improvements in advertising signs are desired. It is therefore an object to provide a novel advertising sign.

This background serves only to set a scene to allow a person skilled in the art to better appreciate the following description. Therefore, none of the above discussion should necessarily be taken as an acknowledgement that this discussion is part of the state of the art or is common general knowledge.

SUMMARY

It should be appreciated that this summary is provided to introduce a selection of concepts in a simplified form that are further described below in the detailed description. This summary is not intended to be used to limit the scope of the claimed subject matter.

Accordingly, in one aspect there is provided an advertising sign comprising: a housing assembly configured to be secured to an upright, the housing assembly having at least one generally planar, primary surface, and configured to releasably retain multiple secondary advertising pieces about the primary surface.

In one or more embodiments, the housing assembly is configured to releasably retain secondary advertising pieces to one or both sides of, below and/or above the primary surface.

In one or more embodiments, the housing assembly is configured to releasably retain secondary advertising pieces to both sides of, below and above the primary surface.

In one or more embodiments, the housing assembly is configured to releasably retain a primary advertising insert in overlying relation with respect to the primary surface.

In one or more embodiments, the housing assembly has a generally planar, opposite facing primary surface, and is configured to releasably retain multiple secondary advertising pieces about the opposite facing primary surface. In one form, the housing assembly is configured to releasably retain secondary advertising pieces at least one of above and below the opposite facing primary surface. In another form, the housing assembly is configured to releasably retain secondary advertising pieces above and below the opposite facing primary surface. In another form, the housing assembly is configured to releasably retain another primary advertising insert in overlying relation with respect to the opposite facing primary surface.

In one of more embodiments, the housing assembly comprises a main body having retaining assemblies on opposite sides thereof, each retaining assembly configured to slidably receive at least one secondary advertising piece having forward and rearward facing advertising surfaces. In one form, each retaining assembly defines spaced raceways to accommodate flanges of the at least one secondary advertising piece. Each retaining assembly may comprise nested channel members spaced apart by an interposed riser, the spacing between the nested channel members defining the raceways. In one form, the housing assembly comprises forward facing upper and lower support panels extending therefrom and configured to support advertising onserts thereon. In this case, the advertising onserts may be secured to the forward facing upper and lower support panels via quick release fasteners. In one form, the housing assembly comprises rearward facing upper and lower support panels extending therefrom and configured to support advertising onserts thereon. In this case, the advertising onserts may be secured to the upper and lower support panels via quick release fasteners.

According to another aspect there is provided an advertising sign comprising: a main housing to accommodate an upright passing therethrough and configured to affix to the upright at a desired height, the main housing presenting forward and rearward facing, generally planar, primary advertising surfaces; retaining assemblies extending along opposite sides of the main housing, each retaining assembly configured to releasably retain a secondary advertising insert that presents forward and rearward facing advertising surfaces; forward and rearward facing upper support panels extending upwardly from the main housing and configured to support forward and rearward facing advertising onserts thereon; and forward and rearward facing lower support panels extending downwardly from the main housing and configured to support forward and rearward facing advertising onserts thereon.

In one or more embodiments, each retaining assembly defines spaced raceways to accommodate flanges of the secondary advertising insert. In one form, each retaining assembly may comprise nested channel members spaced apart by an interposed riser, the spacing between the nested channel members defining the raceways.

In one or more embodiments, the advertising onserts are secured to the forward and rearward facing upper and lower support panels via quick release fasteners.

BRIEF DESCRIPTION OF THE DRAWINGS

Embodiments will now be described by way of example only with reference to the accompany drawings in which.

DETAILED DESCRIPTION

Figure 1:
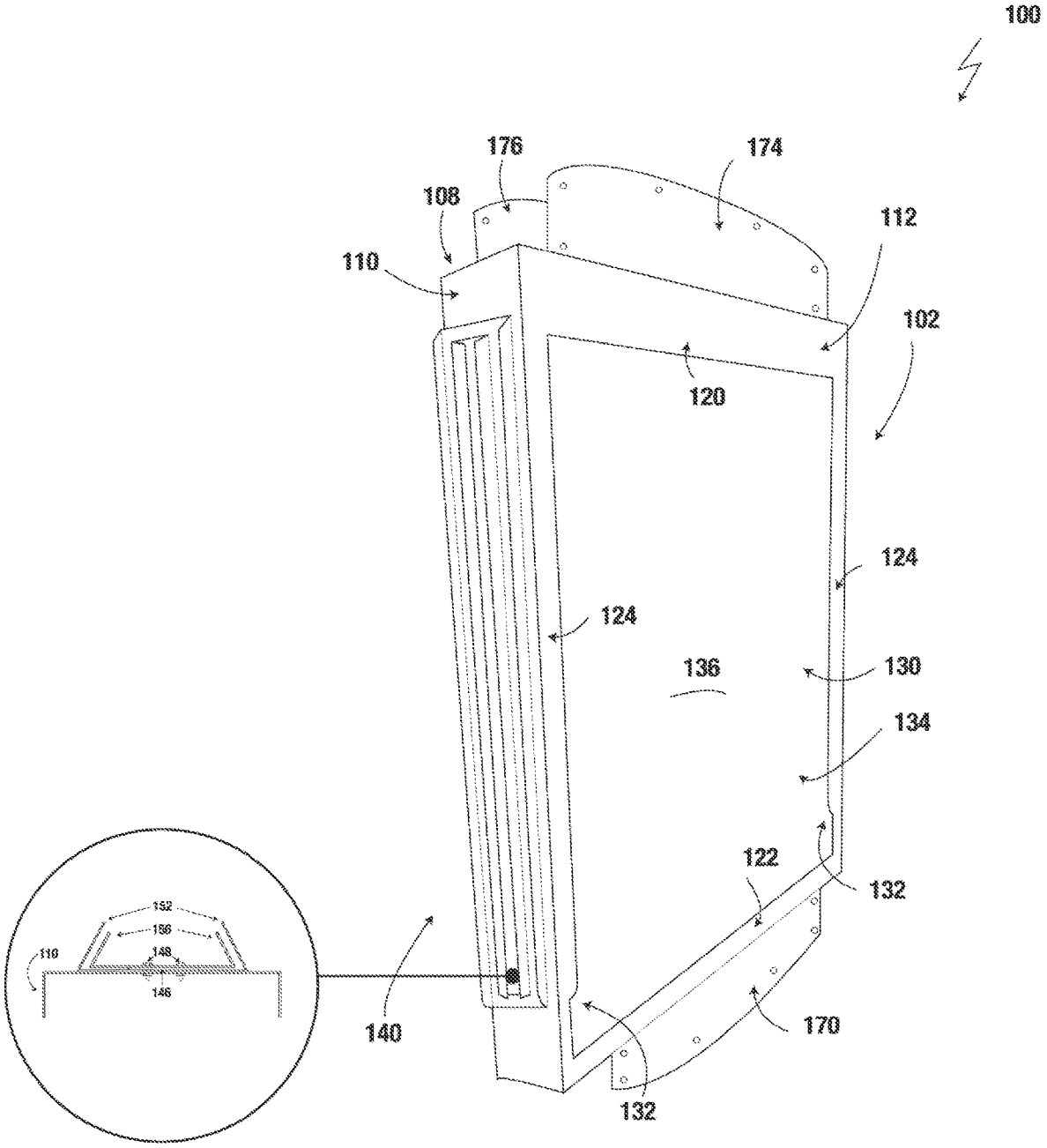
FIG. 1 is a front perspective view of an advertising sign in accordance with the subject disclosure.
Figure 2:
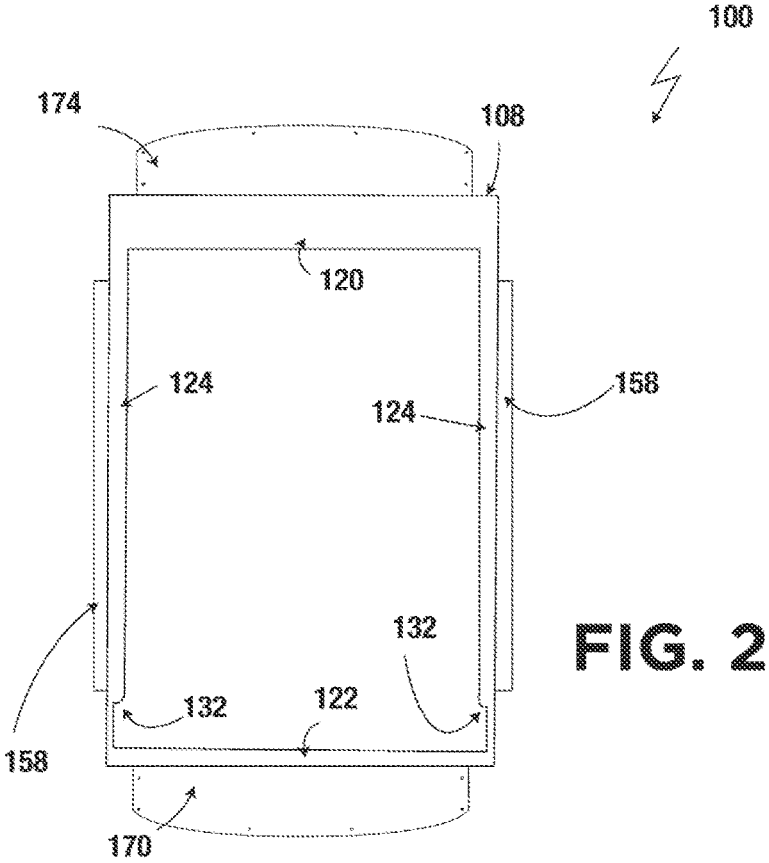
FIG. 2 is a front elevational view of the advertising sign of FIG. 1.

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Reference herein to "example" means that one or more feature, structure, element, component, characteristic and/or operational step described in connection with the example is included in at least one embodiment and/or implementation of the subject matter according to the subject disclosure. Thus, the phrases "an example," "another example," and similar language throughout the subject disclosure may, but do not necessarily, refer to the same example. Further, the subject matter characterizing any one example may, but does not necessarily, include the subject matter characterizing any other example.

Unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including but not limited to" and the terms "comprising", "having" and "including" have equivalent meanings.

As used herein, the term "and/or" can include any and all combinations of one or more of the associated listed elements or features.

Reference herein to "configured" denotes an actual state of configuration that fundamentally ties the element or feature to the physical characteristics of the element or feature preceding the phrase "configured to."

It will be understood that when an element or feature is referred to as being "on", "attached" to, "connected" to, "coupled" to, "contacting" etc. another element or feature, that element or feature can be directly on, attached to, connected to, coupled to, or contacting the other element or feature or intervening elements may also be present. In contrast, when an element or feature is referred to as being "directly" on, "directly attached" to, "directly connected" to, "directly coupled" to, "directly contacting" etc. another element or feature, there are no intervening elements or features present. Similarly, it will be understood that when an element is referred to as being "directly between" other elements, that element is positioned between the other elements without any intervening elements. In contrast, when an element is referred to as being "between" other elements, that element is positioned between the other elements but intervening elements may also be present.

It will be understood that spatially relative terms such as "bottom", "under", "below", "lower", "over", "upper", "top", "front", "back", "side" and the like, may be used herein for ease of describing the relationship of an element or feature to another element or feature as depicted in the figures. The spatially relative terms can however, encompass different orientations in use or operation in addition to the orientation depicted in the figures.

As used herein, the terms "approximately", "about", "generally", "substantially" etc. represent an amount or characteristic close to the stated amount or characteristic that still performs the desired function or achieves the desired result. For example, the terms "approximately" and "about" in reference to a stated amount include amounts that are within engineering or design tolerances of the stated amount that would be readily appreciated by a person skilled in the art. Similarly, for example, the term "substantially" in reference to a stated characteristic of an element includes elements that nearly completely provide the stated characteristic, and the term "generally" in reference to a stated characteristic of an element includes elements that predominately provide the stated characteristic.

Unless otherwise indicated, the terms "first", "second" etc. are used herein merely as labels, and are not intended to impose ordinal, positional, or hierarchical requirements on the elements to which these terms refer. Moreover, reference to a "second" element does not require or preclude the existence of a lower-numbered element (e.g., a "first" element) and/or a higher-numbered element (e.g., a "third" element).

In the subject disclosure, an advertising sign is described that comprises a housing assembly configured to be secured to an upright, the housing assembly having at least one generally planar, primary surface, and configured to releasably retain multiple secondary advertising pieces about the primary surface. The multiple pieces of secondary advertisement are retained in a manner that facilitates quick installation and change outs as will be described.

Turning now to FIGS. 1 to 4, an exemplary advertising sign is shown and is generally identified by reference numeral 100. In this embodiment, the advertising sign 100 is configured to be attached to an upright such as a pole, pylon or the like in an outdoor environment and is configured to support numerous advertising pieces that can be changed out quickly and easily as will be described.

In this embodiment, the advertising sign 100 comprises a hollow, generally rectangular housing assembly 102 that is configured to surround the upright. A mounting bracket (not shown) is provided within the interior of the housing assembly 102 that cooperates with band clamps to affix the housing assembly 102 to the upright at a desired height so that advertising pieces in the form of inserts and onserts can be prominently displayed.

The housing assembly 102 comprises a main housing 108 formed of durable structural material such as aluminum or other metal that is resistant to rust and weathering. In this embodiment, the main housing 108 comprises a pair of opposite side walls 110, a peripheral front wall 112 extending between front edges of the side walls 110 and a peripheral rear wall 114 extending between rear edges of the side walls 110. The peripheral front wall 112 comprises upper, lower and side portions 120, 122, and 124, respectively. The peripheral front wall 112 surrounds a window or opening 130. The side portions 124 of the peripheral front wall 112 are notched near the bottom or lower end of the main housing 108 as indicated by reference numeral 132.

The main housing 108 accommodates a backer panel 134 that is positioned behind the peripheral front wall 112 to close off the window 130. In this embodiment, the backer panel 134 is made of an aluminum composite and is secured to the main housing 108 via suitable fasteners such as steel nuts and bolts. The backer panel 134 presents a forward facing, generally planar major or primary surface 136 configured to bear indicia in the form of more permanent or static advertising such as a company name, brand and/or logo.

Although not shown, the peripheral rear wall 114 has basically the same configuration as the peripheral front wall 112 and comprises upper, lower and side portions. The peripheral rear wall 114 surrounds a window or opening. The side portions of the peripheral rear wall 114 are notched near the bottom or lower end of the main housing 108. A backer panel is accommodated by the main housing 108 and is positioned behind the peripheral rear wall 114 to close off the window. Similarly, the backer panel is made of an aluminum composite and is secured to the main housing 108 via suitable fasteners such as steel nuts and bolts. The backer panel presents a rearward facing, generally planar major or primary surface configured to bear indicia in the form of more permanent or static advertising such as a company name, brand and/or logo.

The housing assembly 102 further comprises a pair of side insert retaining assemblies 140 configured to receive and retain side advertising inserts as will be described, with each side insert retaining assembly 140 extending along a respective side wall 110 of the main housing 108. In this embodiment, the side insert retaining assemblies 140 are also formed of durable structural material such as aluminum or other metal that is resistant to rust and weathering.

Figure 3:
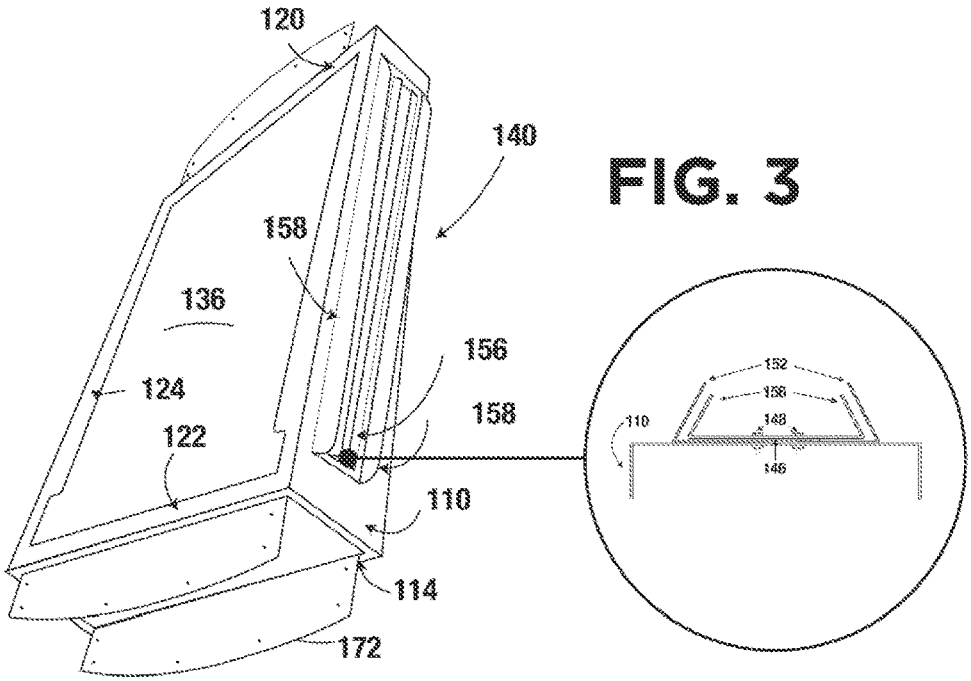
FIG. 3 is a side perspective view of the advertising sign of FIG. 1.
Figure 4:
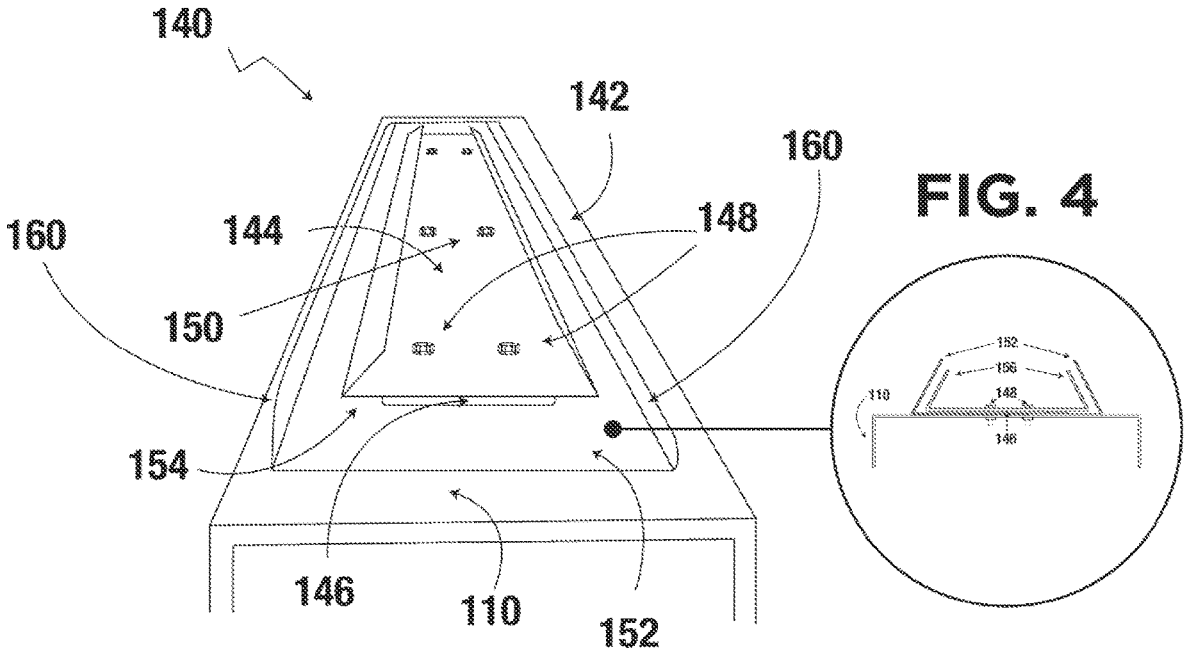
FIG. 4 is a view looking upwardly along one side of the advertising sign of FIG. 1.

FIGS. 3 and 4 better illustrate one of the side insert retaining assemblies 140. As can be seen, the side insert retaining assembly 140 comprises an elongate inner channel member 142 that extends along the respective side wall 110 of the main housing 108, an elongate outer channel member 144 received by and nested within the inner channel member 142 and an elongate riser 146 interposed between the inner and outer channel members 142 and 144, respectively. Fasteners 148 such steel nuts and bolts pass through the inner and outer channel members 142 and 144, the riser 146 and the side wall 110 at spaced locations along the length of the side insert retaining assembly 140 to secure the side insert retaining member 140 to the main housing 108.

The elongate riser 146 is narrower than the base 150 of the outer channel member 144 and spaces the base 150 of the outer channel member 144 from the base 152 of the inner channel member 142 to provide relief between the bases 150 and 152 and define slots 154 on opposite sides of the elongate riser 146. The outer channel member 144 is also narrower than the inner channel member 142 and is configured so that the inwardly angled arms 156 of the outer channel member 144 are inwardly spaced from the arms 158 of the inner channel member 142 to define passageways 160 that are contiguous with the slots 154 and define raceways to receive portions of a side advertising insert as will be described. In this embodiment, the elongate riser 146 is dimensioned to space the base 150 of the outer channel member 144 from the base 152 of the inner channel member 142 by a distance of approximately 6 mm. Those of skill in the art will however appreciate that the dimensions of the elongate riser 146 may varied to adjust the spacing between the bases 150 and 152 as needed.

The housing assembly 102 further comprises a plurality of support panels or extensions adjacent the top and bottom of the main housing 108. Similar to the main housing 108 and side insert retaining assemblies 140, the support panels are formed of durable structural material such as aluminum or other metal that is resistant to rust and weathering. In particular, a bottom support panel or beard 170 is attached to the interior surface of lower portion 122 of the peripheral front wall 112 and extends downwardly from the main housing 108. Likewise, a bottom support panel 172 is attached to the interior surface of the lower portion of the peripheral rear wall 114 and extends downwardly from the main housing 108 A top support panel or header 174 is attached to the interior surface of the upper portion 120 of the peripheral front wall 112 and extends upwardly from the main housing 108. Likewise, a top support panel 176 is attached to the interior surface of the upper portion of the peripheral rear wall 114 and extends upwardly from the main housing 108. Each of the support panels 170, 172, 174, and 176 has a plurality of holes 180 formed therein that are positioned adjacent their peripheral edges at spaced locations.

The advertising sign 100 is configured to receive and hold multiple advertising pieces in a manner that allows the advertising pieces to be easily installed and removed. This allows promotional and other time sensitive advertising to be installed on the advertising sign 100 as needed to supplement more permanent advertising and then be readily changed out when required.

Figure 5:
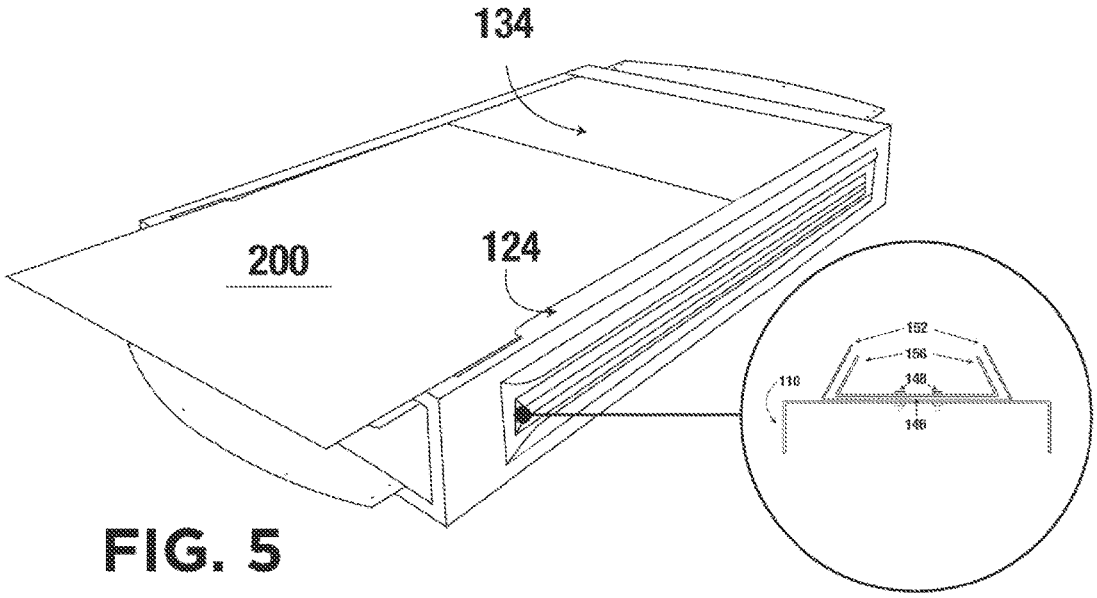
FIG. 5 is another perspective view of the advertising sign of FIG. 1 showing a partially installed main advertising insert.
Figures 6, 7:
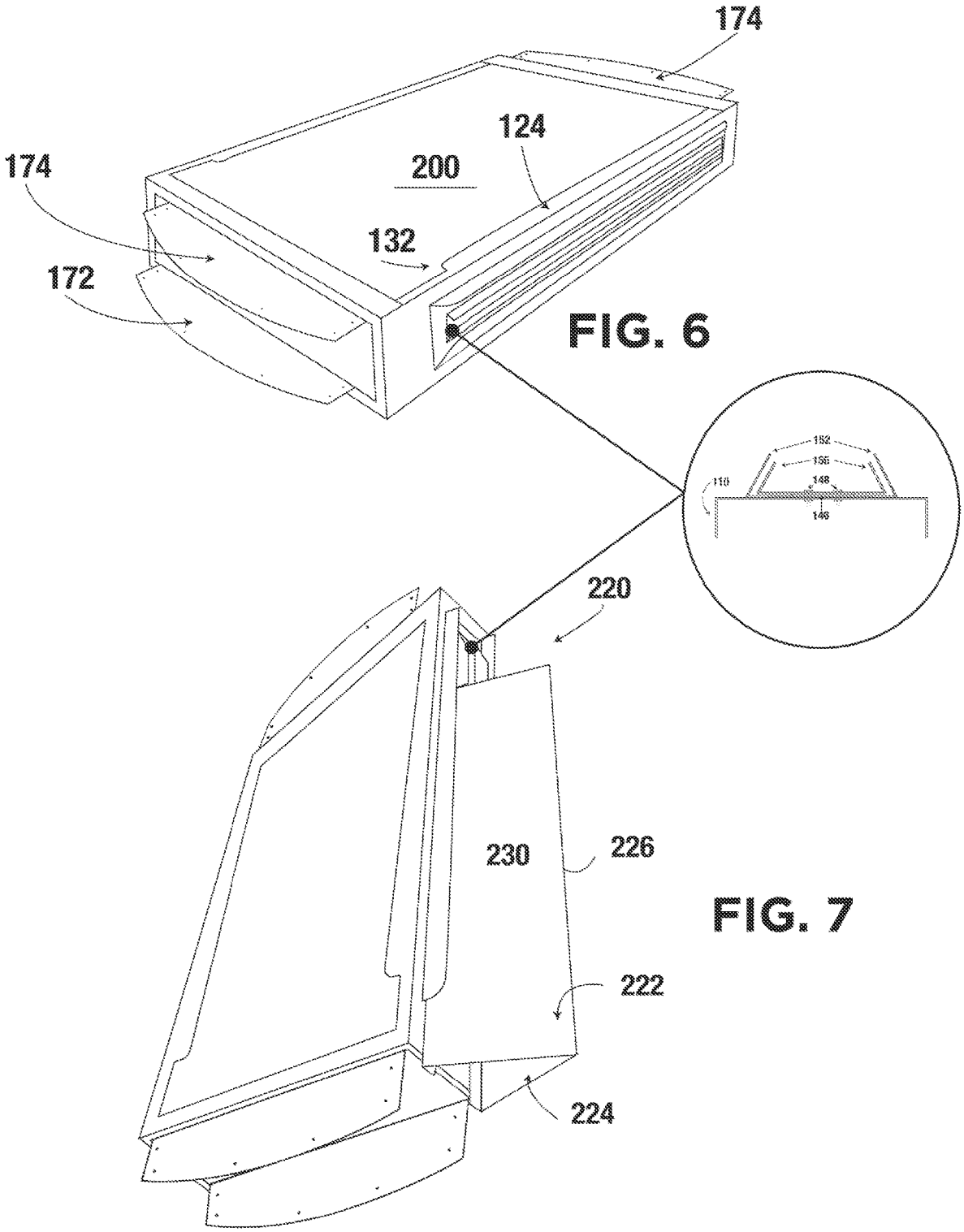
FIG. 6 is another perspective view of the advertising sign of FIG. 1 showing the main advertising insert fully installed.
FIG. 7 is a side perspective view of the advertising sign of FIG. 1 showing a partially installed side advertising insert.

As can be seen in FIGS. 5 and 6, the front and rear of the main housing 108 are configured to receive and retain primary advertising inserts 200 in the form of sheets or panels formed of weather resistant material such as plastic, coated paperboard etc. For example, to install a primary advertising insert 200 on the front of the main housing 108, opposite ends of the top edge of the primary advertising insert 200 are inserted behind the side portions 124 of the peripheral front wall 112 at the notches 132 and then the primary advertising insert 200 is slid upwardly (see FIG. 5) until the primary advertising insert 200 fully overlies the backing panel 134 (see FIG. 6). Installing a primary advertising insert on the rear of the main housing 108 is performed in a similar manner. As will be appreciated, the provision of the notches 132 in the side portions 124 of the peripheral front and rear walls 112 and 114, respectively, facilitates quick installation of primary advertising inserts 200. Also, by spacing the notches 132 above the lower end of the main housing 108, access to the bottom edges of installed primary advertising inserts 200 is facilitated allowing them to be easily grasped. This of course allows installed primary advertising inserts 200 to be quickly removed by pulling the primary advertising inserts 200 downwardly until the top edges of the primary advertising inserts clear the side portions 124 of the peripheral front and rear walls 112 and 114 at the notches 132.

Figure 8:
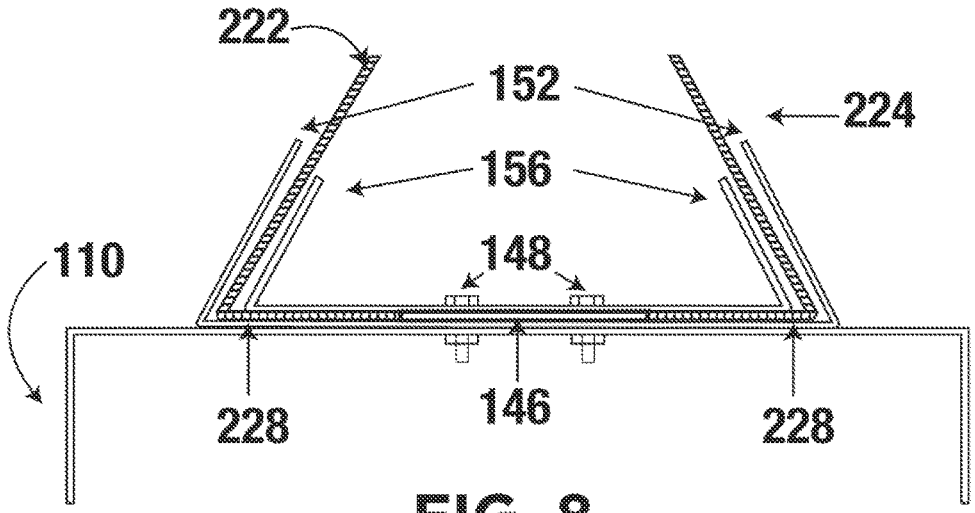
FIG. 8 is a fragmentary view of a portion of the advertising sign of FIG. 1 showing the side advertising insert fully installed.
Figure 11:
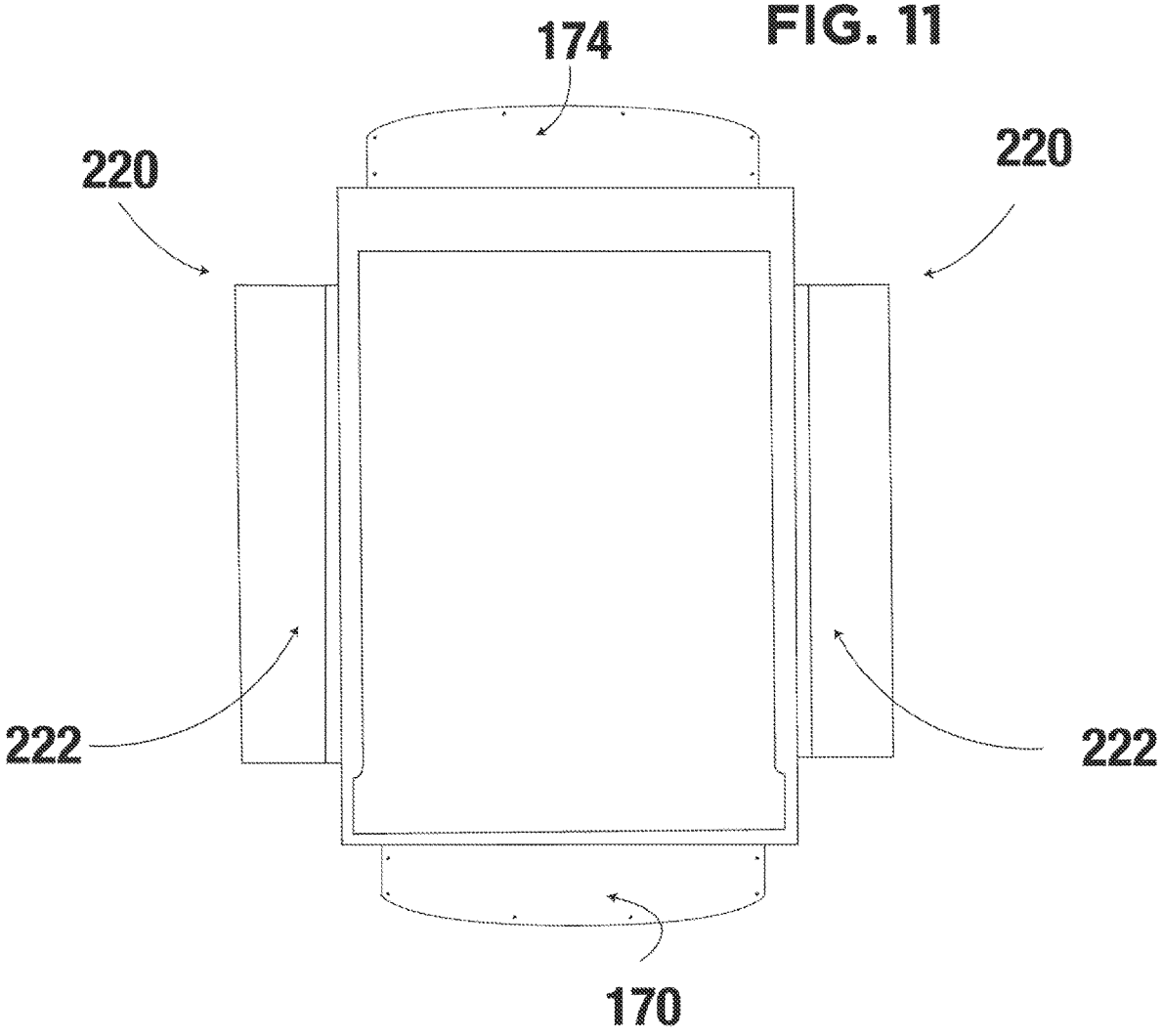
FIG. 11 is a front elevational view of the advertising sign of FIG. 1 showing side advertising inserts fully installed.

The side insert retaining assemblies 140 are configured to receive and retain side advertising inserts 220 formed of weather resistant material such as plastic, coated paperboard etc. as best shown in FIGS. 7, 8, and 11. In this embodiment, the side advertising inserts 220 resemble triangular prisms and comprise front and rear panels 222 and 224 that are joined along a common edge 226 and that angle away from one another. An inturned flange or lug 228 is provided at the opposite edge of each panel 222 and 224. The front panel 222 has a forward facing, generally planar surface 230 on which secondary advertising such as a promotion, event etc. is presented. The rear panel 224 has a rearward facing, generally planar surface 232 on which secondary advertising such as a promotion, event etc. is presented.

To install a side advertising insert 220 on a side insert retaining assembly 140, the upper end of the side advertising insert 220 is brought into alignment with the lower end of the side insert retaining assembly 140 so that the inturned flanges 228 are aligned with the slots 154 and the angled panels 222 and 224 are aligned with the passageways 160 between the arms 156 and 158. The side advertising insert 200 and is then slid upwardly along the raceways with the slots 154 receiving the inturned flanges 228 and the passageways 160 receiving the panels 222 and 224 (see FIGS. 7 and 8) until the side advertising insert 220 is fully installed (see FIG. 11). Removing installed side advertising inserts 220 is a simple task and simply requires sliding of the side advertising inserts downwardly along the raceways until the upper ends of the side advertising inserts 220 clear the lower ends of the side insert retaining assemblies 140.

Figure 9:
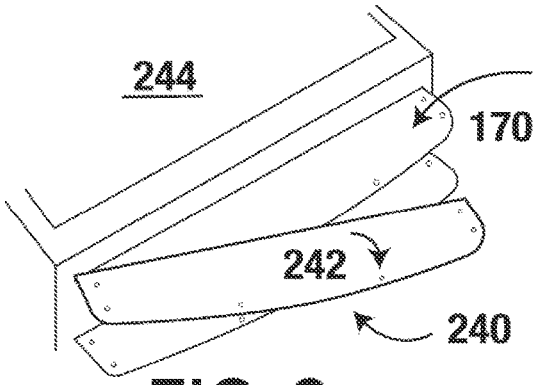
FIG. 9 is a partial perspective view of the advertising sign of FIG. 1 showing a partially installed lower advertising onsert.
Figure 10:
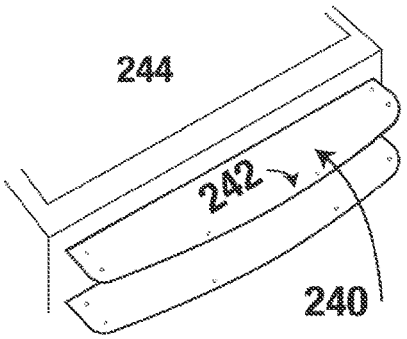
FIG. 10 is a partial perspective view of the advertising sign of FIG. 1 showing the lower advertising onsert fully installed.

The bottom and top support panels 170, 172, 174, and 176 are configured to support upper and lower, generally planar advertising panels sometimes referred to as "Onserts™" 240 formed of weather resistant material such as plastic, coated paperboard etc. as best shown in FIGS. 9 and 10. In this embodiment, the advertising panels 240 have a shape that generally matches the shape of the support panels and have holes 242 formed therein that are arranged in a pattern that matches the arrangements of holes 180 formed in the support panels. Each advertising panel 240 has a major, generally planar surface 244 on which secondary advertising such as a promotion, event etc. is presented.

To install an advertising panel 240 onto one of the support panels, the advertising panel 240 simply needs to be placed over the support panel with the holes 242 in the advertising panel 240 in alignment with the holes 180 in the support panel. Quick release fasteners such as Viking screws can then be inserted through the aligned holes and fastened thereby to secure the advertising panel 240 to the support panel. Removing installed advertising panels simply requires the quick release fasteners to be released.

As will be appreciated by those of skill in the art will appreciate, the dimensions of the advertising sign 100 with the advertising pieces may vary depending on the environment in which the advertising sign is deployed. In one embodiment, the long dimension of each support panel is 39⅜" and the short dimension of each support panel at its maximum point is 8½". The height of the advertising sign 100 from the top support panel 174, 176 to the bottom support panel 170, 172 is 85¼". The side advertising inserts 220 have a length dimension of 48" and a width dimension of 11" giving the advertising sign 100 a width dimension of 67½".

Although the main housing 108, side insert retaining assemblies 140 and support panels 170, 172, 174, and 176 have been described as being formed of durable structural material such as aluminum or other metal, those of skill in the art will appreciate that other materials may be employed especially dependent on the environment in which the advertising sign 100 is deployed. For example, if the advertising sign 100 is to be employed in protected or indoor environments, less-durable structural material may be used.

In the embodiments described above, the housing assembly 102 comprises upper and lower support panels at both its front and rear sides. Those of skill in the art will appreciate that different arrangements of support panels 170, 172, 174, and 176 are possible. For example, the housing assembly 102 may comprise only upper support panels or only lower support panels. Alternatively, only one side of the housing assembly may be provided with one or more support panels or one side of the housing assembly may be provided with an upper support panel and the opposite side may be provided with a lower support panel.

In the embodiments described above, a side insert retaining assembly is provided on each side of the main housing 108. Those of skill in the art will appreciate that only one side of the main housing 108 may be provided with a side insert retaining assembly 140.

Those of skill in the art will appreciate that the side advertising inserts 220 need not be in the form of triangular prisms and may take other geometric shapes (e.g. rectangular parallelepipeds).

Although the backer panels 134 and side insert retaining assemblies 140 have been described as being secured to the main housing 108 via steel nuts and bolts, those of skill in the art will appreciate that other suitable fasteners such as rivets, welds etc. may be employed. Also, other quick release fasteners or fastening mechanisms may be employed to retain the advertising onserts on the support panels 170, 172, 174, and 176.

Although the housing assembly 102 is described as being generally rectangular, those of skill in the art will appreciate that the housing assembly may take other suitable geometric shapes. Depending on the geometric shape, additional side insert retaining assemblies 140 may be employed.

Although embodiments have been described above with reference to the accompanying drawings, those of skill in the art will appreciate that other variations modifications may be made.

What is claimed is:

1. An advertising sign comprising:

a housing assembly configured to be secured to an upright, the housing assembly having at least one generally planar, primary surface, and configured to releasably retain multiple secondary advertising pieces about the primary surface, wherein the housing assembly comprises a main body having retaining assemblies on opposite sides thereof, each retaining assembly configured to slidably receive at least one secondary advertising piece having forward and rearward facing advertising surfaces, wherein each retaining assembly defines spaced raceways to accommodate flanges of the at least one secondary advertising piece, and wherein each retaining assembly comprises nested channel members spaced apart by an interposed riser, the spacing between the nested channel members defining the raceways.

2. The advertising sign according to claim 1, wherein the housing assembly is further configured to releasably retain secondary advertising pieces below and/or above the primary surface.

3. The advertising sign according to claim 1, wherein the housing assembly is further configured to releasably retain secondary advertising pieces both below and above the primary surface.

4. The advertising sign according to claim 1, wherein the housing assembly is configured to releasably retain a primary advertising insert in overlying relation with respect to the primary surface.

5. The advertising sign according to claim 1, wherein the housing assembly has a generally planar, opposite facing primary surface, and is configured to releasably retain multiple secondary advertising pieces about the opposite facing primary surface.

6. The advertising sign according to claim 5, wherein the housing assembly is configured to releasably retain secondary advertising pieces at least one of above and below the opposite facing primary surface.

7. The advertising sign according to claim 6, wherein the housing assembly is configured to releasably retain secondary advertising pieces above and below the opposite facing primary surface.

8. The advertising sign according to claim 5, wherein the housing assembly is configured to releasably retain another primary advertising insert in overlying relation with respect to the opposite facing primary surface.

9. The advertising sign according to claim 1, wherein the housing assembly comprises forward facing upper and lower support panels extending therefrom and configured to support advertising panels thereon.

10. The advertising sign according to claim 9, wherein the advertising panels are secured to the forward facing upper and lower support panels via quick release fasteners.

11. The advertising sign according to claim 9, wherein the housing assembly comprises rearward facing upper and lower support panels extending therefrom and configured to support advertising panels thereon.

12. The advertising sign according to claim 11, wherein the advertising panels are secured to rearward facing upper and lower support panels via quick release fasteners.

13. An advertising sign comprising:

a main housing to accommodate an upright passing therethrough and configured to affix to the upright at a desired height, the main housing presenting forward and rearward facing, generally planar, primary advertising surfaces;

retaining assemblies extending along opposite sides of the main housing, each retaining assembly configured to releasably retain a secondary advertising insert that presents forward and rearward facing advertising surfaces;

forward and rearward facing upper support panels extending upwardly from the main housing and configured to support forward and rearward facing advertising panels thereon; and forward and rearward facing lower support panels extending downwardly from the main housing and configured to support forward and rearward facing advertising panels thereon, wherein each retaining assembly defines spaced raceways to accommodate flanges of the secondary advertising insert, and wherein each retaining assembly comprises nested channel members spaced apart by an interposed riser, the spacing between the nested channel members defining the raceways.

14. The advertising sign according to claim 13, wherein the advertising panels are secured to the forward and rearward upper and lower support panels via quick release fasteners.

* * * * *